United States Patent [19]

Smith

[11] 4,120,240

[45] Oct. 17, 1978

[54] CONTAINER COMPACTOR

[76] Inventor: George L. Smith, P.O. Box 2153, Sanford, Fla. 32771

[21] Appl. No.: 720,965

[22] Filed: Sep. 7, 1976

[51] Int. Cl.[2] ..... B30B 15/30

[52] U.S. Cl. ..... 100/45; 100/DIG. 2; 100/49; 100/53; 100/215; 100/233; 100/256; 100/266; 100/292; 221/290; 241/36; 241/99

[58] Field of Search ..... 100/DIG. 2, 233, 266, 100/292, 49, 215, 45, 216, 53, 256, 43, 48; 241/34, 36, 99; 221/290

[56] References Cited

U.S. PATENT DOCUMENTS

| | | | |
|---|---|---|---|
| 2,619,150 | 11/1952 | Smith | 100/49 |
| 3,659,520 | 5/1972 | Garrett | 100/292 |
| 3,709,440 | 1/1973 | Kontz | 241/36 |
| 3,776,128 | 12/1973 | Morris | 100/DIG. 2 |
| 3,817,169 | 6/1974 | Bischoff | 100/DIG. 2 |
| 3,916,780 | 11/1975 | Heiser | 100/DIG. 2 |
| 3,960,070 | 6/1976 | McClure | 100/49 |

*Primary Examiner*—Billy J. Wilhite

*Attorney, Agent, or Firm*—Duckworth, Hobby, Allen & Pettis

[57] ABSTRACT

Apparatus for sequentially compacting a plurality of containers includes first and second plates each juxtaposed with respect to the other and having respective compacting surfaces, one of the plates being operated by a cam for effecting the reciprocal operation toward and away from the other plate so as to crush containers between the two compacting surfaces. A magazine is provided above the compacting plates for feeding the containers into the space therebetween, the magazine being pivoted above the plates such that downward rotation of the magazine occurs responsive to the weight of a predetermined number of the containers to operate a switch which energizes the cam mechanism.

13 Claims, 4 Drawing Figures

CONTAINER COMPACTOR

BACKGROUND OF THE INVENTION

1. Field of the Invention

The present invention relates to compactors for containers such as cans and the like and in particular relates to compactors which are useful in compacting containers filled with liquid food product, and which are designed for energy-saving and automatic operation.

2. Description of the Prior Art

A plurality of can crushing devices are disclosed in the prior art. In U.S. Pat. No. 3,772,985, Girten discloses a can crushing apparatus employing a reciprocal motion between two crushing plates, the reciprocal motion being caused by a piston-operated mechanism.

In U.S. Pat. No. 3,776,128, Morris discloses a hopper-like arrangement for transporting containers to be crushed into the compacting apparatus. Other prior art of interest includes the following U.S. Pat. Nos. 2,593,657 to Coon et al; 2,949,078 to Reed; and 2,619,150 to Smith.

One of the problems with prior art can compactors is that such apparatus have been designed for manual operation. This obviously requires a great deal of expense and is undesirable from a cost viewpoint.

Some compactors have been designed for automatic operation, such as the devices described in certain of the prior art patents referred to above, but these arrangements are relatively complex and operate on a "start-stop" cycle which is initiated with each can, and is thus costly to operate in terms of the per can energy requirements of the apparatus.

SUMMARY OF THE INVENTION

The present invention contemplates automatic, low energy consuming apparatus for sequentially compacting a plurality of containers. The apparatus comprises a first plate having a first compacting surface, and a second plate juxtaposed with the first plate and having a second compacting surface. Means are provided for reciprocally moving the second plate toward and away from the first plate so as to effect compacting of containers between the first and second surfaces. A magazine is also provided for feeding the containers into the space between the first and second plates, the apparatus further including means for energizing the reciprocal moving means responsive to the weight of a predetermined number of the containers in the magazine.

In a preferred embodiment of the present invention, means are further provided for continuously operating the moving means during any energization cycle thereof until at least all, save one, of the predetermined number of containers have been compacted. In a specific arrangement, this is achieved with a plurality of switches which are actuated upon movement of the magazine responsive to the weight of the predetermined number of cans, which switches maintain operation of the compactor until the predetermined number of cans, save one, have been fed out of the magazine and into the compacting area between the two plates. As soon as all but one of the predetermined number of cans have been compacted, the switches are de-energized causing the magazine to return to the original position and de-energize the prime mover associated with the reciprocal moving means. It will of course be understood that at any time during the compacting of the predetermined number of cans, the weight of which effects energization of the moving means, additional containers may be dropped onto the magazine and operation is continued until such time as the original predetermined number of containers plus any additional container, save one, fed onto the magazine during this process are compacted. In this way, the apparatus of the present invention achieves efficient, low cost service and a machine capable of automatic operation.

In accordance with another aspect of the present invention the apparatus is provided with a shroud, which together with the compacting plates and the magazine form a funnel through which any liquid product within the containers may be directed away from the compactor. Such an arrangement is especially useful in industrial facilities where unusable product has been canned, and it is desirable to compact the cans for recycling.

THE DRAWING

DETAILED DESCRIPTION

A preferred embodiment of apparatus in accordance with the present invention will now be described with reference to all of the drawings.

A. The Base and Compacting Plates

Figure 1:
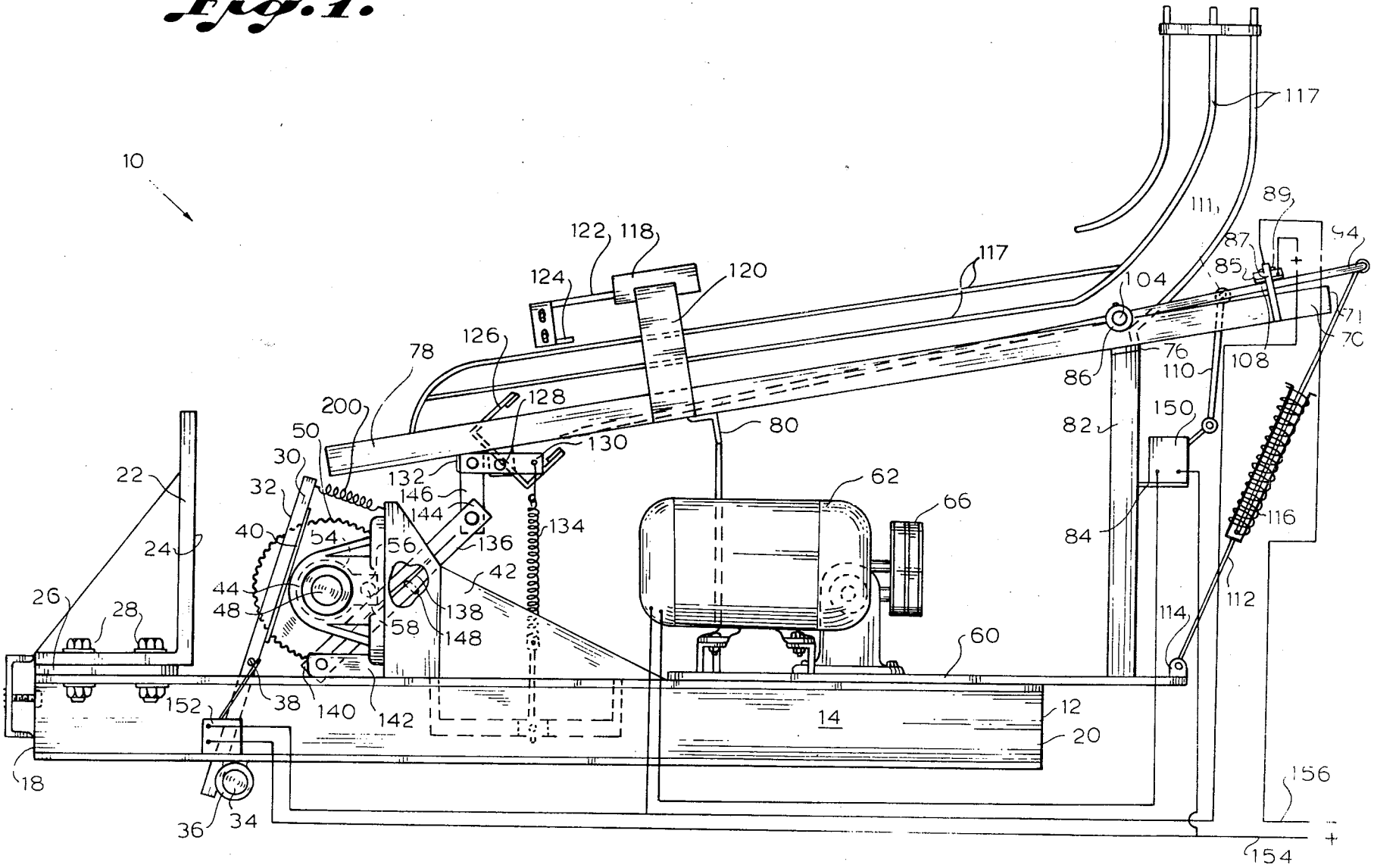
FIG. 1 is a side elevation of a compactor in accordance with the present invention, in which the electrical portion of the apparatus is shown by schematic illustration. A portion of the apparatus of FIG. 1 is removed, as is illustrated in greater in FIG. 3.
Figure 2:
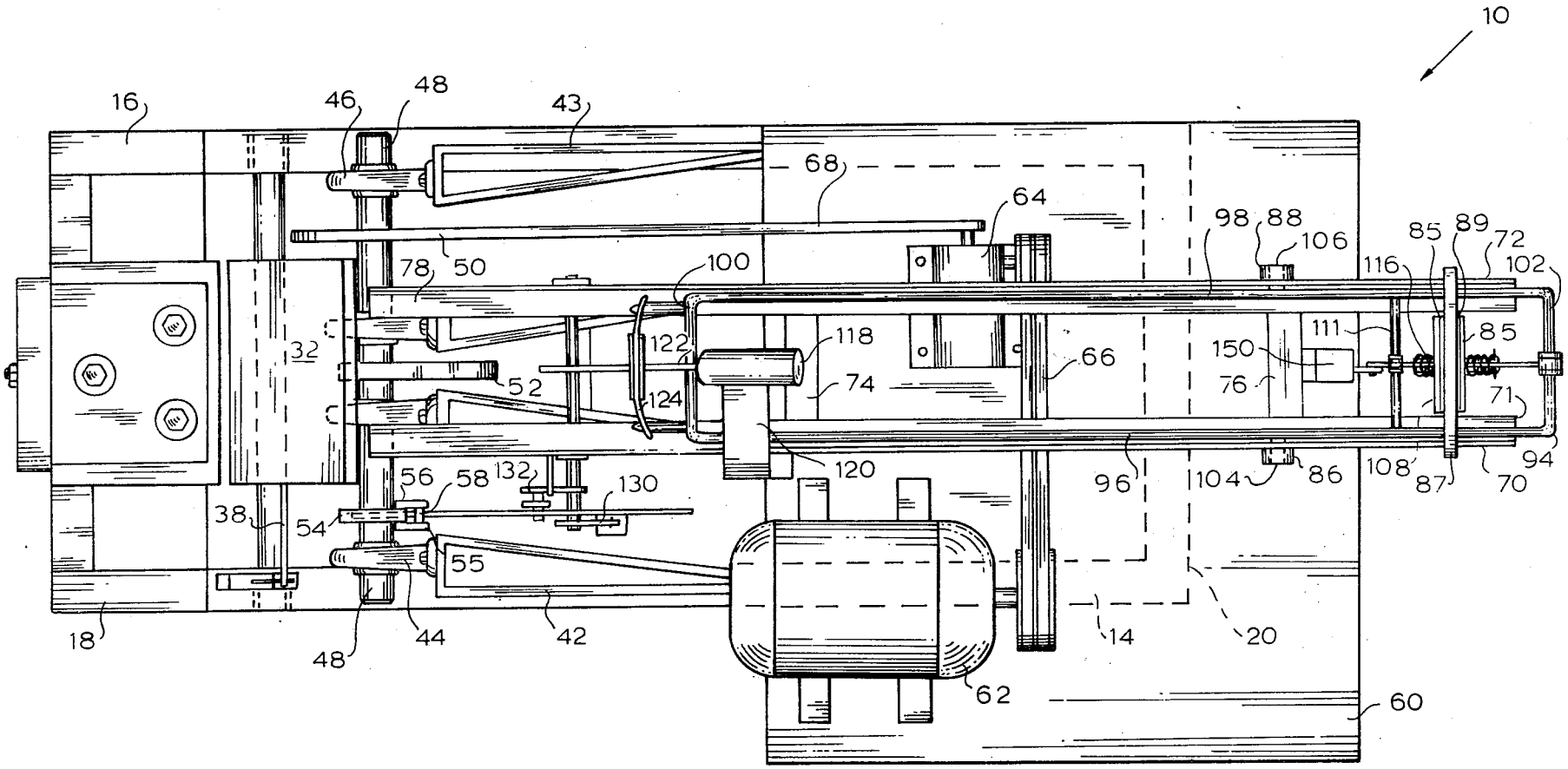
FIG. 2 is a top plan view further illustrating the embodiment shown in FIG. 1.

Noting FIGS. 1 and 2, the apparatus of the preferred embodiment, referred to generally as 10, includes a base 12 formed of front and back brackets 14 and 16 and end brackets 18 and 20 formed between the front and rear brackets. The apparatus 10 further comprises a first compacting plate 22 having a compacting surface 24 and mounted on a cross bracket 26 between the front and rear base brackets 14, 16 by mounting bolts 28. A second compacting plate 30 is provided, having a compacting surface 32 and fixed to a shaft 34, the shaft being mounted by bearings 36 between the front and rear base brackets 14, 16. The second compacting plate 30 includes a switch actuation arm 38 extending laterally therefrom. A bronze wear plate 40 is attached to the rear of the second compacting plate 30, and is adapted to be engaged by a compacting cam 52 described in greater detail below.

B. The Main Cam Shaft Assembly

Figure 4:
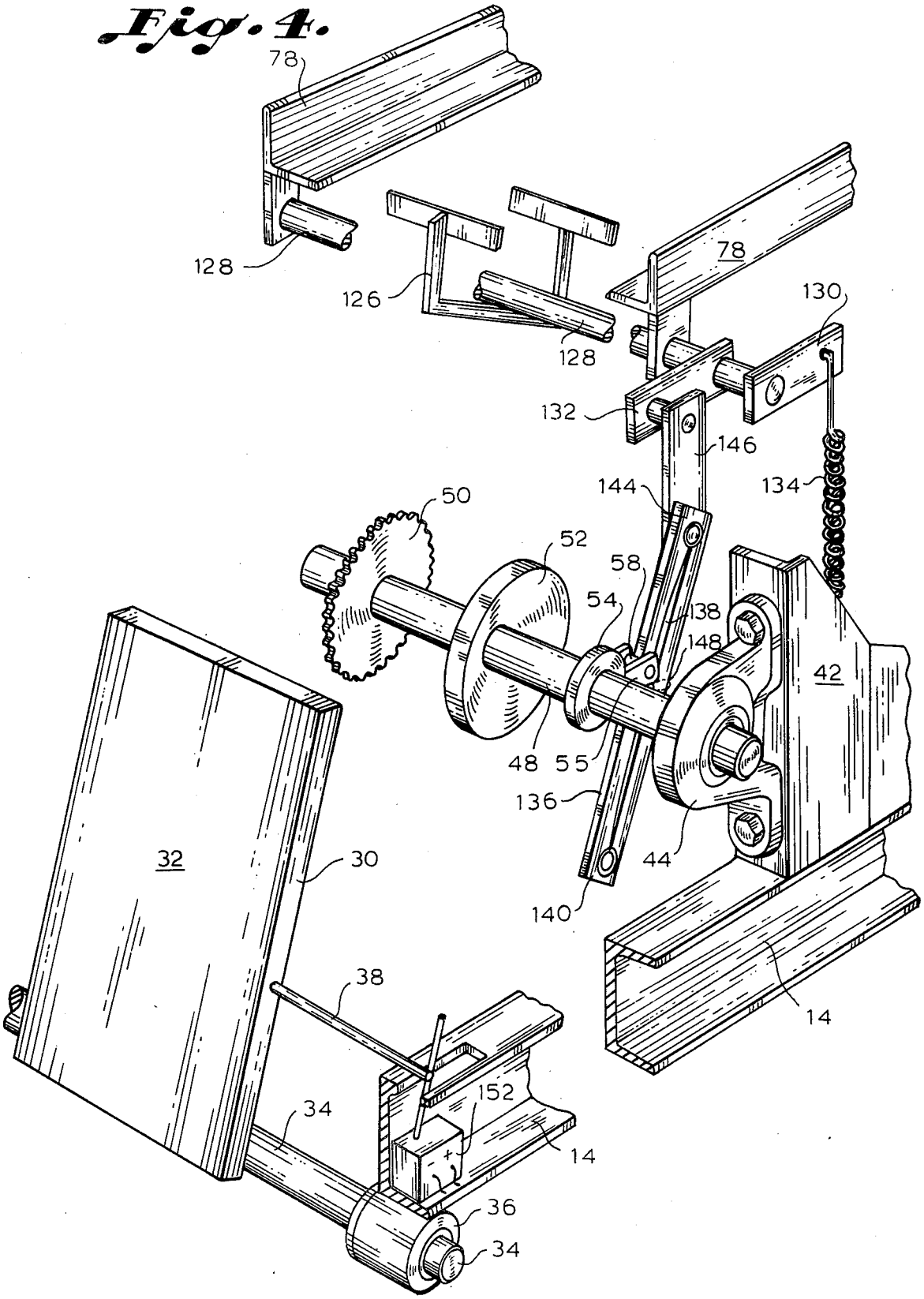
FIG. 4 is a perspective view illustrating another portion of the apparatus of FIG. 1.

Noting FIG. 1, 2 and with specific reference to FIG. 4, the apparatus 10 further includes a pair of supports 42, 43 mounted respectively on the front and rear base brackets 14, 16. A pair of pillow block bearings 44, 46 are provided, each mounted to one of the supports 42, 43 so as to rotatably support a main cam shaft 48 extending therebetween. The cam shaft 48 includes a drive sprocket 50 fixed thereto, and a compacting cam 52 which is adapted to bear against the bronze wear plate 40 and move the second compacting plate 30 toward the first compacting plate 22 so as to effect the compacting of containers positioned therebetween.

The main cam shaft 48 is also provided with a feeder cam 54 having two bearing plates 55, 56 extending therefrom, with a cam roller 58 positioned between the two bearing plates.

C. The Motor and Drive Assembly

Included with the base 12 is a motor support plate 60 having a motor 62 mounted thereon (FIG. 1 and 2). The drive assembly further includes a gear reduction box 64 mounted on the upper surface of the support plate, with a first drive belt 66 between the motor 62 and the gear box 64. A second drive belt 68 is positioned between the gear reduction box 64 and the drive sprocket 50, so as to effect rotation of the main cam shaft 48 in a conventional manner.

D. Magazine Assembly

Figure 3:
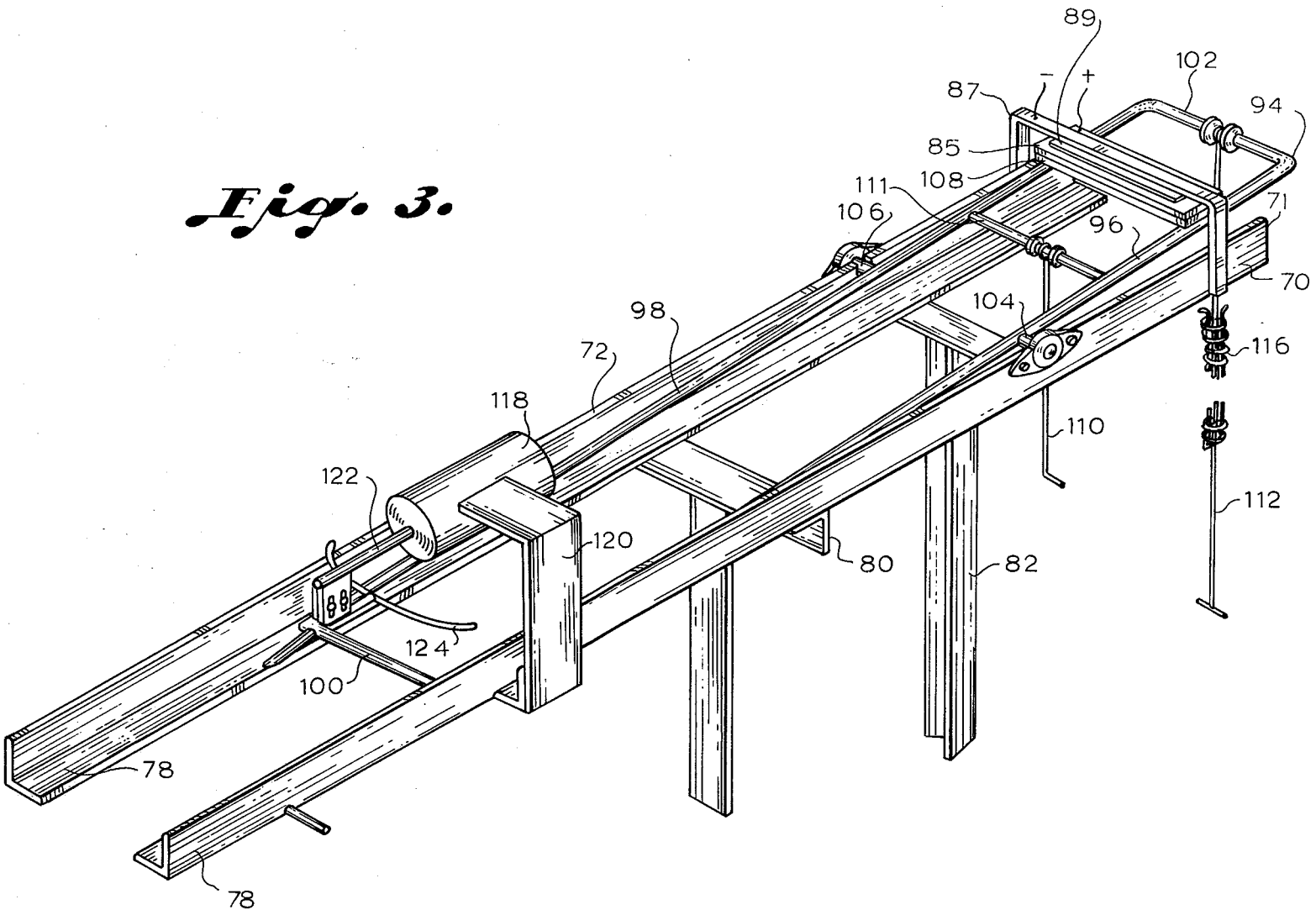
FIG. 3 is a perspective of a portion of the apparatus of FIG. 1.

As shown in FIGS. 1, 2 and 3, the apparatus further includes a magazine assembly having a container track bed formed of two angle brackets 70, 72 separated by spreaders 74, 76 a distance such that the top and bottom of a cylindrical container losely fits between the two angle brackets so as to roll toward the discharge end 78. The magazine brackets 70, 72 are positioned above the base 12 with the discharge end 78 over the space between the compactor plates 22, 30 when in the open, noncompacting position. In this embodiment, the magazine brackets 70, 72 are maintained in this elevated position by risers 80, 82 attached to the motor support plate 60. A switch bracket 84 for an actiation switch 150, described in greater detail below, is mounted on the rearmost riser 82. An electromagnet 85 is mounted on the input end 71 of the angle brackets 70, 72 by a mounting bracket 87 and an insulator 89.

The magazine assembly is further provided with flange bearings 86, 88 with corresponding shaft depressions mounted on opposing sides of the angle brackets 70, 72 for receiving the pivot pins of the pivot track 94, described next.

The pivot track 94 includes opposing side rails 96, 98 dimensioned so as to fit loosely within the angle bracket 70, 72 and end rails 100, 102 between the two side rails. Two opposing pivot pins 104, 106 are mounted on respective ones of the side rails 96, 98 so as to extend into a corresponding one of the flange bearings 86, 88 such that the discharge end of the pivot track 94 may be pivoted up and down about an axis defined by the pivot pins 104, 106. A ferrous attraction plate 108 is mounted across the side rails 96, 98 of the pivot track 94 at the discharge end 70 of the magazine and cooperates with the electromagnet 85 in a manner described in greater detail below. A switch actuation arm 110 is mounted on a rod 111 between the side rails 96, 98 of the pivot track 94. A counterbalance spring shaft 112 is likewise mounted on the end rail 102 of the pivot track 94, and includes a bracket 114 attached at one end for joining the shaft 112 to the motor support plate 60. A counterbalance spring 116 is provided with the shaft, to effect a conventional bias arrangement between the bracket 114 and the end rail 102 of the pivot track 94. The magazine is further provided with conventional guide rails 117 to effect movement of containers to be compacted onto the pivot track 94.

E. Container Stop Assembly

The container stop assembly includes a shock absorber 118 mounted by a carrying bracket 120 to the angle brackets 70, 72 midway between the discharge end 78 and the input end 71 (FIGS. 1 and 3). The absorber 118 is provided with an arcuate member 124 attached to the shock absorber via a shaft 122, the arcuate stop member being dimensioned over the pivot track 94 such that a container to be crushed will be stopped by the arcuate member 124 when the discharge end 100 of the pivot track 94 is in the up position; that is, when the discharge end 100 of the pivot track is rotated upwards about the pivot ends 96, 98. The arcuate stop member 124 is further dimensioned such that the containers to be compacted will pass underneath the arcuate member when the discharge end 100 of the pivot track 94 is in the "down" position, i.e., when the pivot track 94 is rotated about the pivot pins 96, 98 in the manner specifically shown in FIG. 1. In this way, containers to be compacted are allowed to pass underneath the arcuate stop member 124 and into the feeder cam assembly, described next.

F. Feeder Cam Assembly

As shown in FIGS. 1 and 4, the feeder cam comprises a U-shaped feeder bracket 126 fixed to a feeder shaft 128 rotatably mounted across the discharge end 78 of the magazine bracket 70, 72 such that the forwardmost container drops into the U-shaped bracket 126 after passing under the arcuate stop member 124. The feeder cam assembly further includes lateral rocker arms 130, 132 fixed at one end of the feeder shaft 128, the extremity of one arm 130 biased downward by a feeder return spring 134 attached to the base 12. Compound motion between the cam roller 58 (driven by the cam shaft 48) and the feeder bracket 126 is effected by an adjustable cam arm 136 formed of a thin, rectangular member having a slot 138 along the greatest dimension. One end 140 of the cam arm 136 is rotatably pinned to a bracket 142 attached to the support 42, the other end 144 attached to a secondary arm 146 pinned to the second lateral rocker arm 132. The cam arm 136 includes a set screw 148 for effecting minor adjustments in the throw of the entire cam assembly, to thereby effect minor changes in the angular disposition of the U-shaped feeder bracket 126.

G. Switch Assembly

Noting FIG. 1, the apparatus 10 further includes a plurality of electrical switches for controlling operation of the motor 62, to thereby effect automatic operation of the apparatus 10. A first actuation switch 150 is mounted on the bracket 84 attached to the riser 82, the switch being operated by the switch actuation arm 110 attached to the pivot track 94. A second switch 152 is mounted on the base 12 adjacent the second plate 32, the switch arm of the switch 152 being alternately operated by the lateral switch arm 38 extending from the second compacting plate 32. The apparatus 10 is further provided with electrical conductors 154, 156 for defining the circuit path which is shown schematically in FIG. 1.

H. Operation

Initially, containers, such as cylindrical cans of the type described above, are gravity fed onto the magazine and across the pivot track 94. Downward motion of the containers is halted by the arcuate stop member 124 which causes the containers to accumulate along the pivot track 94. When the weight of the containers in accumulation overcomes the counterbalance spring 116, the discharge end 100 of the pivot track 94 swings downward and comes to rest on the angle brackets 70, 72 of the cam track. As the pivot track 94 swings downward into the operating position, the switch actuation arm 110 energizes the first switch 150, which in turn effects energization of the motor 62.

As the first container passes under the arcuate stop member 124 and drops into the feeder bracket 126, the main cam shaft 48 rotates the feeder bracket 126 via the feeder assembly described above. This rotation of the feeder bracket 126 causes the container to be discharged at the discharge end 100 of the pivot track 94, causing the can to come to rest between the first and second plates 22, 30. Further rotation of the main cam shaft 48 causes the first compactor plate 30 to move toward the first plate via rotation of the drive cam 52. At the same time, the lateral switch actuation arm 38 engages the second switch 152, which energizes the electromagnet 85. Throughout the compacting cycle the electromagnet 85 remains on, holding the discharge end 100 of the pivot track 94 in the down position via attraction of the ferrous attraction plate 108 and therefore maintaining energization of the motor 62.

As the main cam shaft 48 completes the rotation cycle, the container between the compactor plates 22, 30 is flattened and exits through the opening between the plates when the second plate 30 returns to the rest position by means of a return spring 200.

In the rest position, the second switch 152 is disengaged. However, the pivot track 94 is held down by the position of the next container under the arcuate stop member 124, thus continuing energization of the motor and rotation of the main cam shaft 48. This container underneath the arcuate stop member 124 remains in this position until the second compactor plate 30 is advanced far enough to engage the second switch 152. This effects energization of the electromagnet 85, pulling the pivot track 94 upward at the input end 102 and downward at the discharge end 100, allowing the next container under the arcuate stop member 124 to roll into the feeder bracket 126. This process is repeated until no containers remain under the arcuate stop member 124. At the time the last container in the feeder bracket 124 is fed off of the end of the pivot track 94, the pivot track rotates back to the original position with the discharge end 100 in the up position moving the first switch 150 to the off position. All of the containers in the magazine have now been compacted except the last, which remains between the compacting plates 22, 30 to be compacted at such time as additional containers are fed into the magazine.

In a preferred embodiment, the apparatus 10 is provided with a shroud arrangement for directing liquid food product within the containers to be crushed out of the space between the compacting plates 22, 30.

I claim:

1. Apparatus for sequentially compacting a plurality of containers comprising:

a first plate having a first compacting surface;

a second plate juxtaposed with said first plate and having a second compacting surface;

means for reciprocally moving said second plate toward and away from said first plate so as to effect compacting of containers between said first and second compacting surfaces;

a magazine for sequentially feeding most of said containers into the space between said first and second plates when in an open, noncompacting position;

means for energizing said reciprocal moving means responsive to the weight of a predetermined number of said containers in said magazine and continuously operating said moving means during any energization cycle thereof until most of said predetermined number of containers are compacted;

a first shaft; and means coupling said moving means and said sequential feeding means to said first shaft so that each is commonly operative responsive to rotation of said first shaft.

2. The apparatus recited in claim 1 further comprising:

said magazine having an input end and a discharge end;

means for supporting said magazine such that said discharge end is positioned over said first and second plates wherein containers exiting said discharge end are gravity fed into said space between said first and second plates when said plates are in said open, noncompacting position; and said supporting means further including means for supporting said input end in an elevated position with respect to said discharge end.

3. The apparatus recited in claim 2 wherein said energizing means comprises:

means for pivoting said magazine to said support means about a pivot axis between said discharge end and said input end, said pivot axis being substantially normal to the direction of container feed along said magazine; and biasing means for maintaining said input end of said magazine in a down position until overcome by the weight of said predetermined number of containers on said discharge end thereof.

4. The apparatus recited in claim 3 further comprising means at said input end of said magazine for holding said input end in an up position until most of said containers have passed across said discharge end.

5. The apparatus recited in claim 4 further comprising:

a container stop along said magazine toward said discharge end; and wherein said magazine and said stop are dimensioned such that said containers pass underneath said stop after the downward rotation of said discharge end of said magazine about said pivot axis.

6. The apparatus recited in claim 3 wherein said reciprocal moving means further comprises:

a shaft carried by said supporting means; and a cam rotatable with said shaft and having a cam surface bearing against said second plate to effect movement of said second plate toward said first plate.

7. The apparatus recited in claim 6 wherein said reciprocal moving means comprises:

a prime mover; and means coupling said shaft to said prime mover to effect rotation thereof.

8. The apparatus recited in claim 7 wherein said energizing means further comprises:

a first switch;

means for operating said switch responsive to a downward movement of said discharge end of said magazine about said pivot axis; and means for energizing said prime mover responsive to operation of said first switch.

9. The apparatus recited in claim 6 further comprising:

means for sequentially feeding each of said predetermined number of cans into said space between said first and second surfaces; and means coupled between said feeding means and said shaft so as to effect operaation of said feeding means by rotation of said shaft.

10. The apparatus recited in claim 9 wherein said feeding means comprises a generally U-shaped bracket rotatably mounted adjacent said discharge end of said magazine for sequentially receiving said containers, said shaft effecting rotation of said bracket to cause sequential feeding of each container into said space.

11. The apparatus recited in claim 3 wherein said continuous operating means comprises a first switch for energizing said moving means responsive to a downward movement of said discharge end of magazine.

12. The apparatus recited in claim 11 wherein said continuous operating means further comprises a second switch coupled to said second plate for continuing energization of said moving means responsive to movement of said second plate.

13. Apparatus for sequentially compacting a plurality of containers, comprising:

first and second compacting members having respective first and second compacting surfaces;

means for moving one of said compacting members toward and away from the other compacting member so as to effect compacting of containers between said first and second compacting surfaces;

a magazine for holding said containers;

means for sequentially feeding said containers from said magazine and into the space between said first and second compacting surfaces when apart in an open, non-compacting position;

means for simultaneously energizing said moving means and said sequential feeding means responsive to the presence of a predetermined weight of said containers in said magazine; and means coupling said sequential feeding means in synchronization with said moving means.

* * * * *